United States Patent [19]

New et al.

[11] 4,050,847

[45] Sept. 27, 1977

[54] LIGHTWEIGHT FAN

[75] Inventors: Gordon R. A. New; William G. Curry, both of Chatham, Canada

[73] Assignee: Fram Corporation, East Providence, R.I.

[21] Appl. No.: 718,789

[22] Filed: Aug. 30, 1976

[51] Int. Cl.[2] ..... F04D 29/34

[52] U.S. Cl. ..... 416/132 A; 416/210 R; 416/DIG. 3

[58] Field of Search ..... 416/DIG. 3, 210, 132 A

[56] References Cited

U.S. PATENT DOCUMENTS

| | | | |
|---|---|---|---|
| 1,313,598 | 8/1919 | Ingells | 416/DIG. 3 X |
| 1,352,848 | 9/1920 | Stanyo | 416/DIG. 3 |
| 1,634,554 | 7/1927 | Pajalic | 416/DIG. 3 |
| 2,794,509 | 6/1957 | Mix | 416/DIG. 3 |
| 2,912,159 | 11/1959 | Granger et al. | 416/DIG. 3 |
| 2,965,180 | 12/1960 | Killam | 416/DIG. 3 |
| 3,628,888 | 12/1971 | Wooden | 416/243 X |

FOREIGN PATENT DOCUMENTS

| | | | |
|---|---|---|---|
| 393,131 | 6/1933 | United Kingdom | 416/232 |

*Primary Examiner*—Everette A. Powell, Jr.

[57] ABSTRACT

A fan blade, secured to an arm of the fan, extends radially outwardly beyond the arm and is secured to the arm by a plurality of rivets, a continuous circular rib being formed about the radially outermost rivet, the rib comprising on one side of the blade a groove having a depth and a cross-sectional radius equal to the blade material thickness.

9 Claims, 5 Drawing Figures

LIGHTWEIGHT FAN

This invention relates to fans and more particularly to automotive fans having rigid blades designed to maintain their configuration in use.

Rigid bladed fans have long been used for automotive cooling. Blade rigidity has typically been achieved through the use of relatively thick steel blades. The weight of the blades in turn has dictated the use of relatively heavy material for the supporting structure as well.

The use of rigid lightweight blades would permit the use of a lighter spider for an overall weight and material cost reduction. A lighter fan, additionally, reduces power consumption by the fan and hence enhances vehicle fuel economy. Unfortunately, attempts to use lighter than conventional rigid blade material has resulted in repeated failures with conventional fastening means, blade cracking occurring adjacent the outermost rivets securing blades to the supporting spider arms.

It is, thus, a principal object of this invention to eliminate the blade cracking found to occur about the outermost rivets of a fan without, however, adding weight to the fan.

In general, the invention features a circular rib formed in a blade extending about and closely adjacent the radially outermost rivet securing the blade to an arm of the fan.

In preferred embodiments the fan blade is positioned against the upstream side of the fan arm, the rivet bears against the upstream side of the blade and the rib extends in an upstream direction away from the arm. Preferably, the rib has a depth no greater than and preferably equal to the blade material thickness and preferably comprises a groove having a radius equal to the blade material thickness. The arm to which the blade is connected, in a preferred embodiment, at its outermost portion is formed on a radius and the rib and rivet are coaxial therewith, the inner diameter of the rib overlying the arm and a portion of the outer diameter of the rib extending beyond the arm. The blade is preferably rigid lightweight steel.

Other objects, features and advantages of this invention will be apparent to those skilled in the art from the following detailed description of a preferred embodiment thereof taken together with the accompanying drawings, in which.

Figure 1:
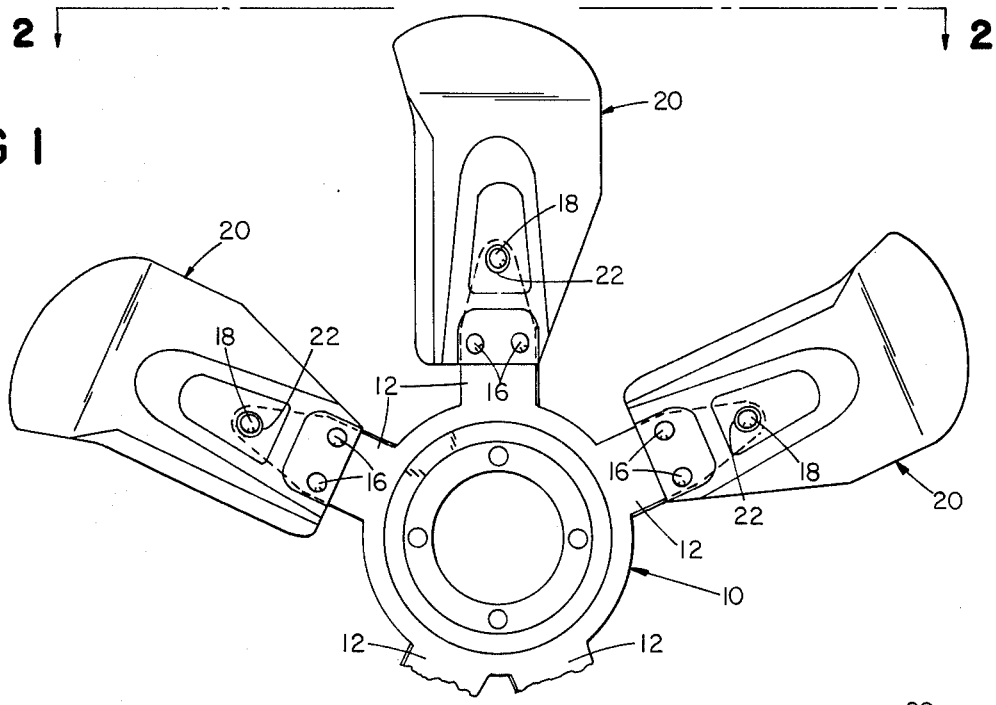
FIG. 1 is a fragmentary plan view of a fan embodying the invention.
Figure 2:
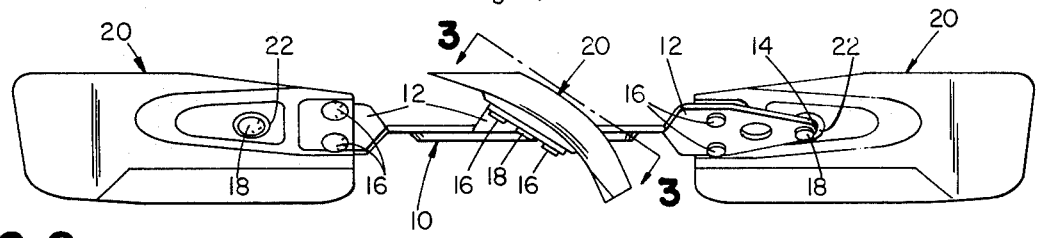
FIG. 2 is a side elevation of the fan illustrated in FIG. 1.

As illustrated in FIGS. 1 and 2, the fan comprises a spider forming a hub 10 and a plurality of arms 12 extending radially outwardly therefrom. Rivets 16,18 bear directly against and secure steel blades 20 to arms 12, the blades 20 extending radially outwardly beyond arms 12.

Figure 3:
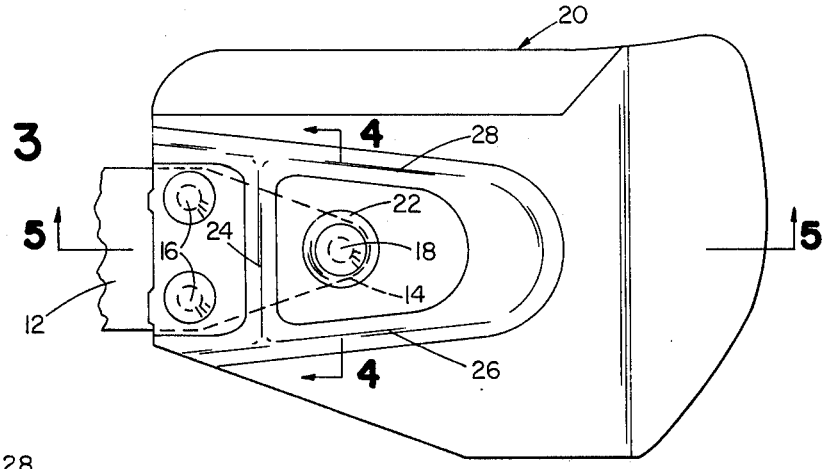
FIG. 3 is an enlarged plan view of a fan blade taken along the line 3—3 of FIG. 2.
Figure 4:
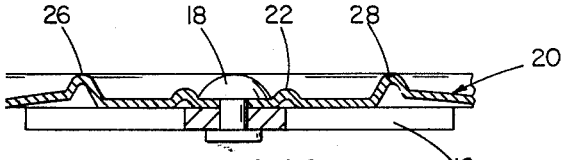
FIG. 4 is an enlarged sectional view taken along the line 4—4 of FIG. 3.
Figure 5:
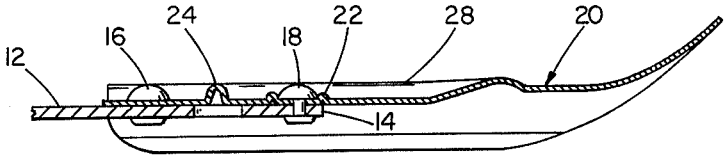
FIG. 5 is a sectional view taken along the line 5—5 of FIG. 4.

As best shown in FIGS. 3–5, a raised circular rib 22 is formed in each blade 20 extending about and closely adjacent the radially outermost rivet 18 securing each blade 20 to its respective arm 12. In the illustrated embodiment, blade 20 is positioned on the upstream side of arm 12, outermost rivet 18 bears against the upstream side of blade 20 and rib 22 projects in an upstream direction away from arm 12.

As shown in FIG. 3, the outer portion of arm 12 is formed in a triangular shape. At its outer end 14, arm 12 is formed on a radius slightly larger than the head of rivet 18. Rivet 18 and rib 22 are coaxial of the arm tip radius. The inner diameter of rib 22 overlies arm 12 but the outer diameter of rib 22 at the arm outer end 14 extends radially beyond arm 12. Thus, spider weight is minimized while the rib is placed as far as possible outward along blade 20 to maximize its strengthening effect.

As shown best in FIG. 4, rib 22 forms a continuous groove on one side of blade 20. The groove preferably has a depth and a cross-sectional radius equal to the blade material thickness. Such a depth maximizes rib strength without weakening the blade material to any significant extent during formation of the rib.

The blade material used in the illustrated embodiment is SAE 950AK, mild steel having a thickness of 0.034 inches compared to blade thicknesses of 0.045–0.060 inches typical of prior fans. Advantageously, the spider in the illustrated material is also made of relatively lightweight material since it is only required to support lightweight blades; the spider material is also SAE 950AK steel, 0.120 inches thick. Blades of the material, aforementioned, are rigid, retaining their predetermined configuration in use.

Additional ribs 24,26,28, provided in the blade, may additionally be necessary or desirable to stiffen the lightweight blade material. Such ribbing has not been found, however, to successfully overcome the failure problem about rivets 18 without the ribs 22.

In operation, as the fan is rotated, blades 20 are dynamically stressed. Even with ribs 24,26 and 28 to stiffen blades 20, cracking of the blades occurs around rivets 18 in the absence of rib 22. The provision of rib 22, however, has been found to eliminate failure at rivets 18, thus making a light-weight, rigid-bladed fan practical. Advantageously, formation of the rib, observing the dimensional limitations aforesaid, avoids any weakening from deformation in the rib formation.

Other embodiments of this invention will be apparent to those skilled in the art which are within the scope of the following claims.

What is claimed is:

1. In a fan comprising a hub having a plurality of arms extending radially therefrom and a fan blade connected by rivets to each said arm and extending radially outwardly therefrom, said rivets located at positions radially spaced along each said arm and blade and the radially outermost of said rivets bearing directly against said blade, the improvement in which said fan blade has a circular rib formed therein extending about said radially outermost rivet and closely adjacent the head of the radially outermost rivet securing said blade to a said arm.

2. The improvement claimed in claim 1 in which said fan blade is positioned against the upstream side of said arm, said rivet head bears against the upstream side of said blade, and said rib protrudes in an upstream direction away from said arm.

3. The improvement claimed in claim 2 in which said rib comprises a groove on one side of said blade, said groove having a depth no greater than about the material thickness of said blade.

4. The improvement claimed in claim 2 in which the outer portion of said rib, spaced away from said outermost rivet, extends radially outwardly beyond said arm and the inner portion of said rib, adjacent said outermost rivet, overlies said arm.

5. The improvement claimed in claim 2 in which the radially outermost portion of said arm is formed on a radius and said rivet and rib are coaxial thereof.

6. The improvement claimed in claim 5 in which the outer portion of said rib, spaced away from said outermost rivet, extends radially outwardly beyond said arm and the inner portion of said rib, adjacent said outermost rivet, overlies said arm.

7. The improvement claimed in claim 6 in which said rib comprises a groove on one side of said blade, said groove having a depth no greater than about the material thickness of said blade.

8. The improvement claimed in claim 7 in which said blade is rigid lightweight steel adapted to substantially maintain its configuration in use.

9. The improvement claimed in claim 8 in which said groove has a cross-sectional radius and a depth equal to said blade material thickness.

* * * * *